US005405147A

United States Patent [19]

Garcia

[11] Patent Number: 5,405,147

[45] Date of Patent: Apr. 11, 1995

[54] BOARD FOR MULTIPLE GAMES

[76] Inventor: Jose L. Garcia, Isaac Peral, 34-6 B, San Fernando, E-11100, Spain

[21] Appl. No.: 255,567

[22] Filed: Jun. 8, 1994

Related U.S. Application Data

[63] Continuation of Ser. No. 917,100, filed as Pct/ES91/00083, Dec. 4, 1994, abandoned.

[30] Foreign Application Priority Data

Dec. 5, 1990 [ES] Spain ..... 9003125

[51] Int. Cl.[6] ..... A63F 3/00

[52] U.S. Cl. ..... 273/284; 273/283; 273/285

[58] Field of Search ..... 273/242, 261, 263, 264, 273/285, 287, 283, 155

[56] References Cited

U.S. PATENT DOCUMENTS

| | | | |
|---|---|---|---|
| 378,931 | 3/1888 | Hyde | 273/285 X |
| 1,997,022 | 4/1935 | Stalker . | |
| 4,515,370 | 5/1985 | Garcia | 273/261 X |
| 4,527,800 | 7/1985 | Samansky | 273/261 |
| 4,614,344 | 9/1986 | O'Connor | 273/283 |
| 4,735,418 | 4/1988 | Engel . | |
| 5,014,995 | 5/1991 | Woodward | 273/261 |
| 5,080,368 | 1/1992 | Weisser | 273/285 X |

FOREIGN PATENT DOCUMENTS

| | | | |
|---|---|---|---|
| 636912 | 9/1963 | Belgium | 273/285 |
| 645107 | 10/1950 | United Kingdom | 273/285 |

*Primary Examiner*—William E. Stoll
*Attorney, Agent, or Firm*—Helfgott & Karas

[57] ABSTRACT

Based on the improvements of the invention it is possible to obtain by a single body, after its corresponding transformation, different boards for practicing multiple games, starting from the development of a rectangular sheet divided in a given number of equilateral triangles equal to each other, each one of which is equipped with a motif or drawing which combined in a given position will form a different game board for each transformed figure, which is obtained after the proper folding of that sheet, through the hinges that the contiguous sides of the triangles constitute, until obtaining a plane body of hexagonal contour formed by six equal triangles, capable of being transformed into another equal hexagon but showing so many other different triangles, up to a total number of five transformations, allowing the attainment of the same number of game boards based on the drawings which are suitably combined in each plane hexagonal figure shaped by each transformation.

2 Claims, 1 Drawing Sheet

BOARD FOR MULTIPLE GAMES

This is a continuation of application Ser. No. 07/917,100, filed as Pct/ES 91/00083, Dec. 4, 1991, now abandoned.

BACKGROUND OF THE INVENTION

Field of the Invention

The invention relates to improvements in game boards, so that based on a same element or body, the latter may be transformed and occupy positions which will determine as many other game boards, the body constituting a module with an articulated geometrical configuration obtained based on the development of an elongated laminar element of rectangular shape.

There are many known types of game boards which, at the most, serve for two different games, such as the case of chess, and there are even laminar boards or bodies in which each one of the sides makes up a different game board, the most common we could mention being parcheesi, on whose opposite side the game board corresponding to snakes and ladders may be represented or even the chess game board may be represented.

On the other hand, there are the so-called "collected games," in which there are several different games in one and the same block, but each one of them requiring a different board, usually constituted by a carton or similar sheet.

In short, there is no known physical body constituting a game board that can be transformed in order to define different game boards.

SUMMARY OF THE INVENTION

The object of the invention is to provide improvements in boards for multiple games, that is to say, based on a single board body, the latter capable of being transformed to contain different representations corresponding to so many other game boards. The board for multiple games according to the present invention is obtained based on the development of a sheet of stampable material, such as cardboard, suitable plastic, etc., which sheet is rectangular and is formed by a succession of equal equilateral triangles, the last of which is extended by its respective side in a small overlap.

The sheet thus constituted is folded starting from the first triangle, which folding is performed in a helicoidal fashion to form a strip or sheet half the length of the original, which is likewise folded in a certain manner to form a regular hexagonal figure formed by six triangular parts equal to each other, each one of which parts may include one, two or three triangles of those which form the original sheet, so that by joining the overlap corresponding to the last triangle to the first triangle, a hexagonal figure is obtained in which the sides of the triangles, which form the hexagonal figure constitute hinges based on which the said hexagonal body may be transformed by changing the position of the sides which form said triangles, so that these being suitably equipped with the corresponding drawings. Each transformation of the hexagon will form a different game board. It is possible to form up to five different boards on the same body, by merely changing the position, based on the articulation determined by the triangular portions of the hexagon, of those triangular sides.

That is to say, according to the invention, an articulated hexagonal module is obtained, which may be transformed so that in each one of the hexagonal planes which are obtainable, a complete game is represented.

Although reference has been made throughout this description to game boards, the object of the invention could likewise be applied to the inscription of mathematical formulas or chemical formulas, or to any other type of activity, such as that of constituting sides for the arrangement or inscription of cards corresponding to sports and similar teams; it could be said that the versatility for each case is very diverse, since it is a question of a hexagonal plane module which is formed based on triangles that by virtue of the articulation of the sides that delimitate each of the triangular parts or zones, the hexagon's plane may be transformed so that in each case one or another of the faces corresponding to the different triangles appears and thus forms or determines one or another game board.

BRIEF DESCRIPTION OF THE DRAWINGS

To complement the description being made and with the object of contributing toward a better understanding of the characteristics of the invention, this specification is accompanied, as an integral part of the same, by drawings in which the following has been represented in an illustrative and not limiting capacity.

DETAILED DESCRIPTION OF THE PREFERRED EMBODIMENTS

Figure 1:
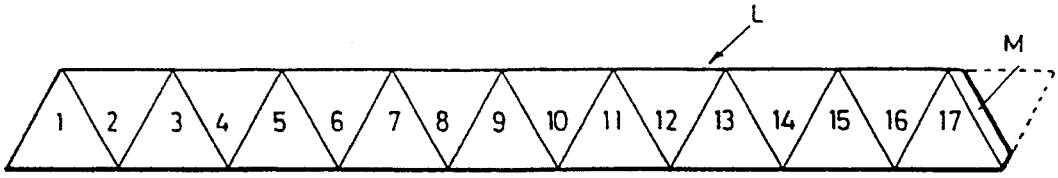
FIG. 1 is a view showing the development of the rectangular sheet based on which the board for multiple games which is the object of the invention is obtained, which sheet is divided into seventeen equal equilateral triangles, one after another and numbered correlatively.
Figure 2:
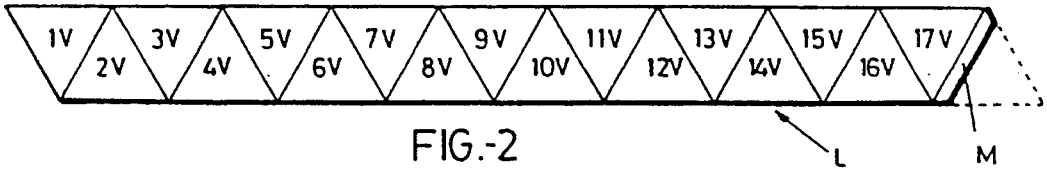
FIG. 2 shows the same sheet as the previous figure, represented by the opposite or reverse side of the same, the triangles in this case having been numbered with the same number as those on the anterior side but followed by the letter "V" indicating that in one case it is a matter of one side and in another case the opposite or reverse side.

In view of the figures mentioned, and making specific allusion to FIGS. 1 and 2, rectangular sheet L may be observed, based on which the module is obtained, through which, after its transformation, different board games will be achieved. The sheet which has oblique ends. The end extends in a small overlap M which affects its entire width, while the rest of sheet L is divided into a certain number of equal equilateral triangles numbered correlatively from 1 to 17, as is observed in FIG. 1, according to one of the sides, while on the opposite side those triangles correspond to the same references followed by the letter V.

Now then, based on the development of sheet L, divided into the numbered equilateral triangles, the folding of the same is next. The fold will be performed in helicoidal fashion beginning from the second triangle, that is to say, of the line of intersection which separates triangles (2) and (3), in a such a way that this fold implies that the sheet is transformed in the body represented in FIGS. 3 and 4, the first triangle (1) seen at its obverse side being observed in FIG. 3, while triangles (3), (4), (7), (8), (11), (12), (15) and (16) are seen at their reverse side, so that all these include the numerical reference followed by the letter V, while in FIG. 4 all the triangles are seen at their reverse side and they are precisely those which are not seen in the face shown in FIG. 3.

Figure 3:
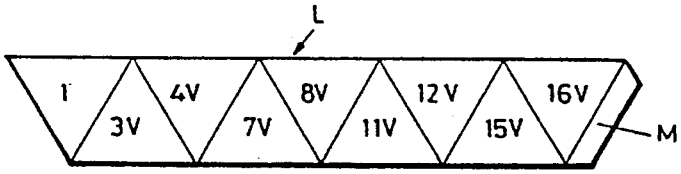
FIG. 3 is a view of the same sheet, once the folding by the successive rolling of the different triangles forming the sheet has been performed.
Figure 4:
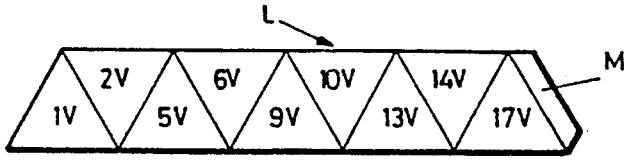
FIG. 4 shows the same sheet represented in the previous figure, seen from the opposite side.
Figure 5:
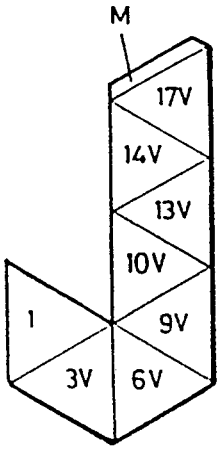
FIG. 5 shows the following folding phase, after attaining the configuration to be obtained.
Figure 6:
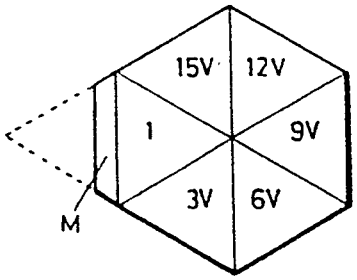
FIG. 6 shows that hexagonal configuration which will constitute the transformable module in which the overlapping of the last triangle is observed, which after its corresponding folding shall be affixed to the obverse of the first triangle to obtain a structure which will not come apart during the transformation which is to take place.
Figure 8:
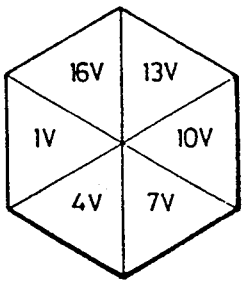
FIG. 8 shows a game board different than that shown in FIG. 6, for example, which has already been transformed based on the representation corresponding to FIG. 7, to show other triangular faces or surfaces which shall determine a different game for each transformation.

The helicoidal fold shown in FIGS. 3 and 4, is followed by proceeding to the fold toward the opposite part, that is to say, outward between the line which delimits the faces or triangles (4V) and (7V), obtaining that which is represented in FIG. 5, to immediately continue folding through the line that delimits the triangles (10V) and (13V), now obtaining the regular hexagonal contour shown in FIG. 8, with flap M arranged to be folded over triangle (1) and thus joining the two ends of sheet L so that if the different triangles which form that sheet L are equipped with drawings which allow the composition of different games, such as parcheesi, a chess board, the "three in line" game, etc, in FIG. 6 the triangles (1), (3V), (6V), (9V), (12V) and (15V) will form a game board according to the drawing those triangles include.

Figure 7:
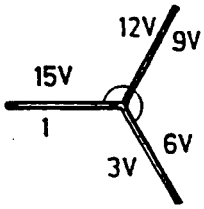
FIG. 7 shows the way based on which the hexagonal plane body shown in the previous figure can be transformed to obtain different game boards.

Now, based on such figure and board, the latter may be transformed, thus obtaining other boards, specifically until obtaining five different boards and therefore allowing the execution of five games with one and the same element, for which it is necessary to fold that hexagon as is shown in FIG. 7, folding on the line which delimits triangles (1) and (15V) and pushing the sides which form triangles (6V) and (9V) toward the hypothetical vertical axis, forming what is represented in FIG. 7, so that based on that the figure may be opened to obtain another hexagon which will represent another game board according to the drawings the faces include, as is shown in FIG. 8, where triangles (1V), (4V), (7V), (10V), (13V) and (16V) may be seen, which, as can be seen, are different from the triangles in FIG. 6 and therefore form another board according to the drawings which have been previously inserted on such triangles.

In this manner, a module is obtained that may be transformed by merely folding the hexagon as is shown in FIG. 7 to then accomplish its opening and obtain in each case a hexagon with different triangles and therefore a different board in each case.

In short, based on a plane suitably drawn in triangles, after the transformation of a regular hexagonal figure obtained by successive folding of the triangles, different game boards may be formed, as a consequence of the fact that the triangles which will show in each transformed hexagonal figure will show a different drawing which will correspond to one or another game board.

Fringe M, as is observed in FIGS. 1, 2 and 6, may adopt other preferred or optional forms as is shown by dots in those figures, where it has the shape of an equilateral triangle.

It is not considered necessary to make this description longer for any expert in the matter to understand the scope of the invention and the advantages which are derived from the same.

The materials, form, size and arrangement of the elements are capable of variation, as long as that does not suppose an alteration of the essence of the invention.

The terms in which this report have been described should always be taken in a wide and not a limiting sense.

I claim:

1. A board for multiple table games, such as parcheesi, chess, or a game requiring a combination or characters such as a series of mathematical or chemical formulas, comprising an articulated hexagonal module formed from a single elongated sheet having ends of oblique shape and divided into a given number of equilateral identical triangles each having on each face thereof a printed pattern, the last of said triangles in said sheet having a flap portion at an end of said sheet and being parallel to said end of said oblique shape so as to form a lateral overlap for being affixed to a first triangle of said elongated sheet, after successive folding of the different triangles at the common side that delimits the triangles consecutively, said hexagonal module when folded having a plane surface on each side, each plane surface including six equal triangles of the triangles which form said single elongated sheet, said six triangles in each plane surface being adjacent to each other so that printed patterns on faces thereof in combination form a predetermined table game or combination of characters required by a game, wherein sides of said triangles form articulating hinges which permit a transformation of each hexagonal figure on each side of the module into another hexagonal figure with different triangles to form a different table game or combination of characters required by a game.

2. The board for multiple table games, according to claim 1, wherein said triangles each carry drawings or patterns suitable for determining in each transformed hexagonal figure a different game board or a different combination of characters.

* * * * *